US007658585B2

(12) United States Patent
Brommer et al.

(10) Patent No.: US 7,658,585 B2
(45) Date of Patent: Feb. 9, 2010

(54) BINDING-IN AND PRESSING MACHINE

(75) Inventors: Carsten Brommer, Techlenburg/Leeden (DE); Torsten Meineke, Bassum (DE)

(73) Assignee: Kolbus GmbH & Co. KG, Rahden (DE)

( * ) Notice: Subject to any disclaimer, the term of this patent is extended or adjusted under 35 U.S.C. 154(b) by 391 days.

(21) Appl. No.: 11/312,988

(22) Filed: Dec. 19, 2005

(65) Prior Publication Data

US 2006/0140742 A1 Jun. 29, 2006

(30) Foreign Application Priority Data

Dec. 23, 2004 (DE) ..... 10 2004 061 996

(51) Int. Cl.

| | |
|---|---|
| ***B42C 13/00*** | (2006.01) |
| ***B42C 11/04*** | (2006.01) |
| ***B42C 7/00*** | (2006.01) |
| ***B42C 11/00*** | (2006.01) |
| ***B42C 5/04*** | (2006.01) |
| ***B42B 9/00*** | (2006.01) |

(52) U.S. Cl. ..... 412/22; 412/29; 412/21; 412/9; 412/17; 412/18; 412/36; 412/902

(58) Field of Classification Search ..... 270/30.01, 270/52.01, 52.08, 52, 16, 52.18, 58.08, 58.09, 270/58.29; 412/1, 4, 5, 6, 8, 9, 10, 17, 18, 412/19, 21, 22, 24, 29, 30, 33, 36, 37, 900, 412/902

See application file for complete search history.

(56) References Cited

U.S. PATENT DOCUMENTS 2,785,812 A * 3/1957 Schramm ..... 414/567
2,799,029 A * 7/1957 Schramm ..... 412/24
2,921,322 A * 1/1960 Crawley et al. ..... 412/13

(Continued)

FOREIGN PATENT DOCUMENTS

DE 12 07 334 B 12/1965

(Continued)

*Primary Examiner*—Dana Ross
*Assistant Examiner*—Justin V Lewis
(74) *Attorney, Agent, or Firm*—Alix, Yale & Ristas, LLP

(57) ABSTRACT

A binding-in and pressing machine (1) with a plurality of pressing stations (60) and heated joint forming rails situated on a reciprocating carriage (50). An alignment station (20) is provided for aligning the book case joints (2*a*) at the height of the joint forming rails (49*a, b*), including a height-adjustable alignment table (21) with rails (22, 23) for supporting the book (2) on the outer edges of its spine and guide elements (28, 6) for centering the book on the alignment table. A separate pre-forming station (40) is also provided that comprises the forming rail (51), clamping plates (41*a, b*), and joint rails (48*a, b*) that engage into the book case joints (2*a*) and counteract a downward movement of at least the book case joints (2*a*). The books (2) aligned in the alignment station (20) are transferred into the pre-forming station (40) while being clamped in lateral regions near the joints. The effective times available for realizing a functionally safe alignment and a permanent pre-forming of the books are extended due to the assignment of the alignment and pre-forming functions to two separate stations.

19 Claims, 4 Drawing Sheets

U.S. PATENT DOCUMENTS 3,451,082 A * 6/1969 Sarring ..... 412/5
3,469,270 A * 9/1969 Thorp ..... 412/22

FOREIGN PATENT DOCUMENTS

DE 37 33 435 A1 4/1989
DE 92 13 920 U1 1/1993
DE 44 22 783 A1 1/1996

* cited by examiner

BINDING-IN AND PRESSING MACHINE

BACKGROUND OF THE INVENTION

The present invention pertains to a binding-in and pressing machine for the joint forming and pressing-in of book blocks cased in book cases.

After casing-in the book block into the book case, a crease-free and permanent bond between the end sheets of the book block and the inner sides of the book is achieved by pressing-in the book. In industrial bookbinding, this full-surface pressing step is carried out on so-called binding-in and pressing machines together with the joint forming process, in which the book case joints are formed and glued.

For example, U.S. Pat. No. 2,921,322 describes a book pressing and joint forming machine that is assembled into a production line together with a casing-in machine. The book pressing and joint forming machine comprises a plurality of pressing stations that are arranged in a straight row and equidistantly spaced apart from one another, wherein each pressing station contains a pair of press plates that lie opposite of one another and serve for exerting pressure upon the sides of a book, and wherein the distance between the opposing press plates is adjustable. Pairs of oppositely arranged and heated joint forming rails are assigned to the pressing stations and realized adjustably with respect to their mutual distance in order to form the book case joints.

The joint forming rails are situated on a reciprocating carriage and simultaneously serve as a transport means for advancing the books from station to station in a cyclic fashion, wherein the joint forming rails subsequently return into their starting position in order to receive and advance another book. Devices as they are known, for example, from DE 92 13 920 U1 are used for aligning a cased-in book in order to carry out the pressing-in and joint forming steps. Such an alignment device comprises a forming bridge for supporting a rounded book, a former for pressing the book block into the book case spine being supported on the forming bridge and alignment means that act upon the front edge of the book case. The thusly aligned book is transported into the first pressing station by means of a first transport means in the form of narrow press jaws that act in lateral regions near the joints and are arranged on the carriage, wherein the book is initially full-surface pressed above these press jaws by the press plates of this first pressing station, and wherein the joint forming of the book case is subsequently carried out during the additional transport by means of a first pair of joint forming rails. Due to the broad spectrum of book formats to be processed as well as the various shapes of book spines, the numerous forming bridges required need to be interchanged with corresponding frequency.

DE 12 07 334 B claims a binding-in and pressing machine that acts upon a series of books and comprises a rotor that is movable about a vertical axis, wherein a plurality of pressing devices that respectively comprise one pair of opposing press plates is arranged on the periphery of said rotor. The rotor intermittently moves the pressing devices into successive pressing stations equipped with joint forming devices that respectively consist of a pair of opposing joint forming jaws. During the cyclic transport of the books through the individual processing stations, the pressure exerted upon the sides of the book is maintained and the joint forming device is closed in the respective stations in order to form the book case hinges and to transmit heat to these regions. In order to insert the books into the pressing devices, a book standing on its spine is raised between the press plates by means of a T-shaped lift carriage, wherein the book is taken hold of and clamped in position by said press plates. In the ensuing station, the press plates are opened such that the pressure exerted upon the book block via the book case is diminished. The book is now (pre-)formed by pressing one forming rail against the;; front edge cut of the book block such that the book block is pressed against the book case spine, wherein the joint forming jaws engage into the book case joints and thusly prevent the entire book from sliding downward.

According to one additional development of this binding-in and pressing machine, the joint forming devices are arranged on and actuated in the same cycle with the pressing devices. The joint forming jaws therefore can remain closed during the rotation such that more time is available for heat to act upon the book case material. A machine according to this additionally developed concept is known from DE 44 22 783 A1, wherein the books are raised into the pressing devices with a loading table that contains prism rails for linearly supporting the book spines in this case. A punch is lowered onto the front edge cut of the book block in the same infeed station as soon as the joint forming jaws are closed and only a slight pressure, if any, is exerted upon the book by the press plates. The cycle of the rotor can only continue once the punch is moved out of the clamping region of the press plates. The cycle capacity of this particular construction is limited due to the numerous and partially very time-consuming functional steps in the infeed station, as well as the limited rotational dynamics of the rotor caused by the high forces of inertia. Although an increase in capacity can be achieved with this pair-by-pair arrangement of the pressing devices on the rotor, this type of arrangement is associated with a substantial additional expenditure for two parallel streams of books, particularly in the infeed and delivery regions of the machine.

SUMMARY OF THE INVENTION

The present invention is based on the objective of making available a binding-in and pressing machine for the joint forming and pressing in of book blocks cased in the book cases, characterized by a comparatively simple and cost-efficient design which can improve the quality of the joint forming and pressing-in steps.

According to one aspect of the invention, a simple and straightforward design of the machine is achieved by the assignment of the aligning and pre-forming functions to two separate stations, as well as the clamped transport of the aligned book blocks between these two stations. This machine makes it possible to achieve cycle capacities that were only possible with very complicated and expensive constructions until now, because the forming rail only carries out a short stroke when it is actuated and released. In addition, the effective times for ensuring a functionally safe alignment and a permanent pre-forming of the books are increased. The utilization of rails that act upon the outer edges of the book spines makes it possible to eliminate interchangeable parts on the alignment table. The clamped transport causes the lateral regions of the book case near the joints to be firmly glued to the end sheets before the pre-forming process. This means that the formation of creases is prevented during the subsequent initial engagement of the joint forming rails into the book case joints.

Other advantageous characteristics of the binding-in and pressing machine are disclosed in the following description of one preferred embodiment as well as the figures.

DESCRIPTION OF THE PREFERRED EMBODIMENT

Figure 1:
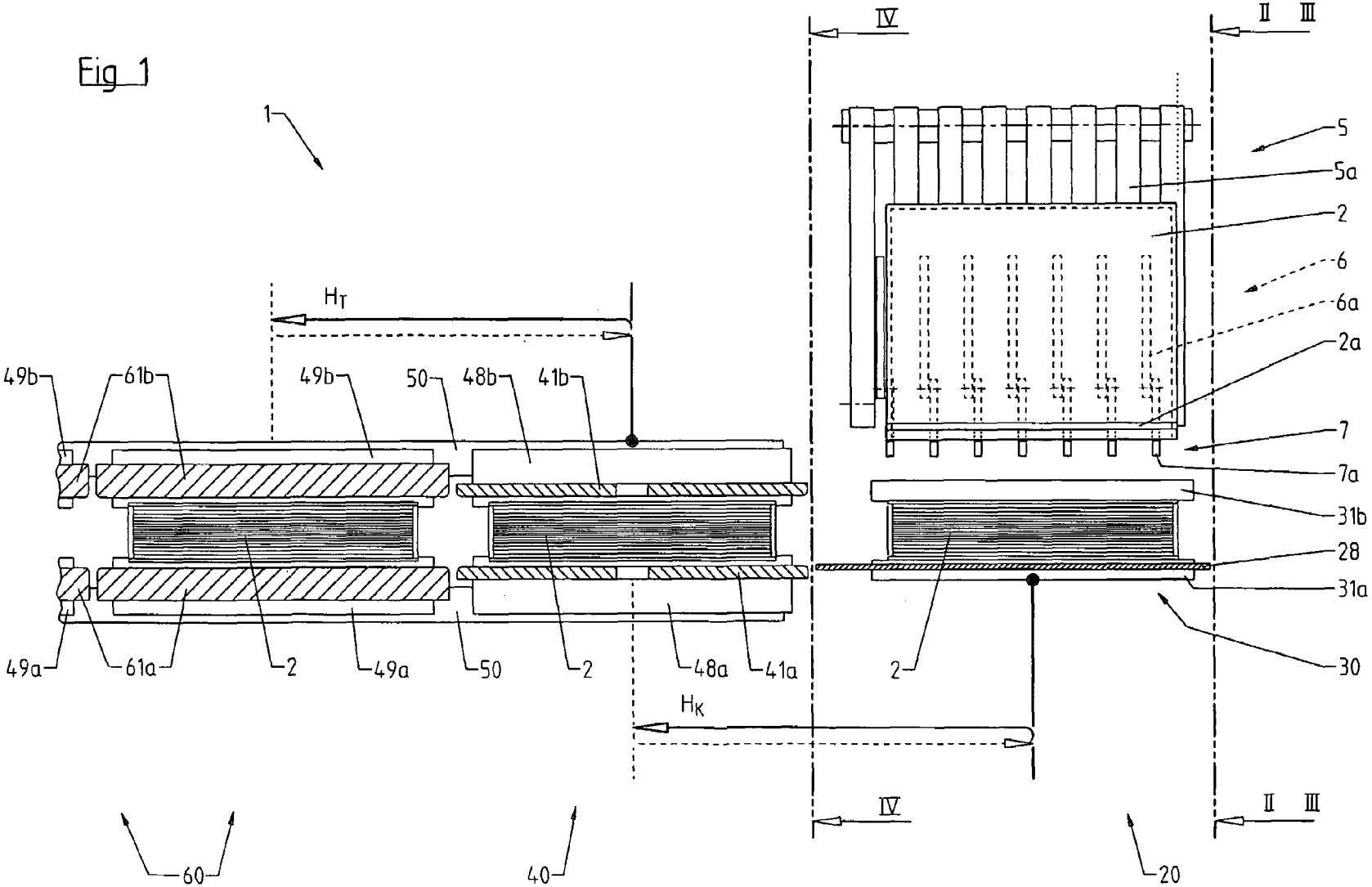
FIG. 1, is a schematic top view of a binding-in and pressing machine.

FIG. 1 shows a schematic top view of a binding-in and pressing machine 1 with pressing stations 60 that are arranged in a straight row and equidistantly spaced apart from one another. The pressing stations respectively contain a pair of oppositely arranged press plates 61*a, b* that serve for exerting pressure upon the sides of a book 2 and can be adjusted with respect to their mutual distance. Heated joint forming rails 49*a, b* assigned to the pressing stations 60 are respectively arranged opposite of one another pair-by-pair and adjustable with respect to their mutual distance. The joint forming rails form the book case joints 2*a*. The joint forming rails 49*a, b* are situated on a carriage 50 and simultaneously serve as a transport means for advancing the books 2 from station to station in a cyclic fashion with a transport stroke HT. The joint forming rails then return into their starting position in order to receive and transport another book 2.

Figure 2:
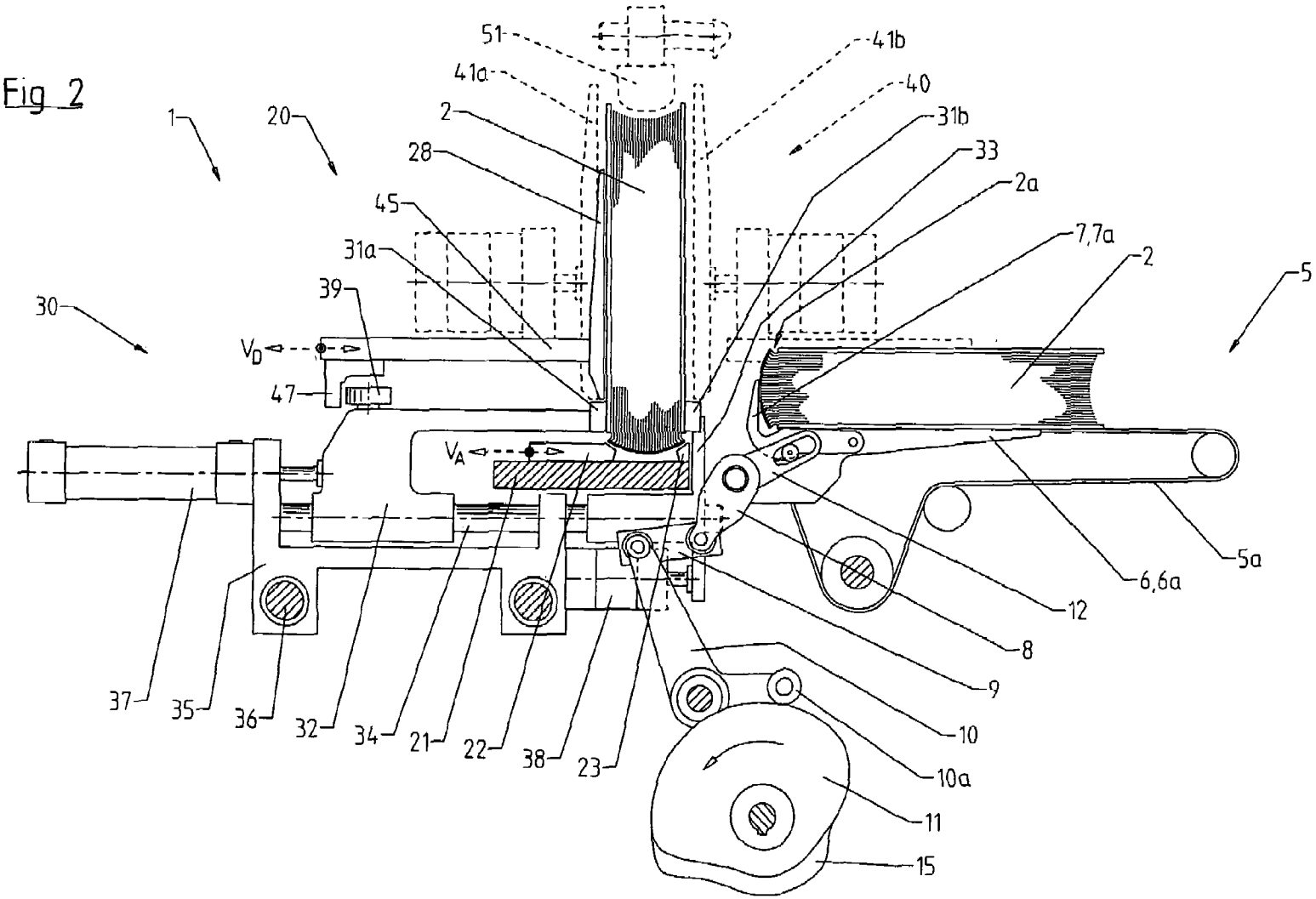
FIG. 2, is a sectioned side view of the alignment station of the machine with a horizontally positioned feeding gate, wherein this figure is sectioned along the line II-II in FIG. 1.

According to the preferred embodiment of the invention, an alignment station 20 and a pre-forming station 40 are arranged upstream of the pressing stations 60. The infeed of the alignment station 20 is formed by a feed conveyor 50 with several adjacently arranged conveyor belts 5*a*, on which the books 2 are flatly transported to a transfer position with their spine pointing forward. This transfer position is defined by the contact of the book spine with the contact tines 7*a* of a contact gate 7 that are supported in a pivoted fashion on supporting tines 6*a* of a feeding gate 6. In the horizontal position of the feeding gate 6 shown in FIG. 2, the tines 6*a* and 7*a* engage into the intermediate spaces between the conveyor belts 5*a*.

The supporting tines 6*a* are accommodated on a common shaft and pivoted back and forward about the respective shaft axis via a lever 8 and a coupler 9 with the aid of a cam lever 10 with a cam roller 10*a* that is controlled by its movement along a cam plate 11, between a horizontal position in which the book 2 is received from the transfer position and a vertical position in which the spine of the vertically arranged book 2 stands on an alignment table 21 of the alignment station 20. The book 2 is not subjected to any sliding or gliding movements in this case, i.e., the books 2 are vertically positioned in a particularly careful fashion.

Figure 3:
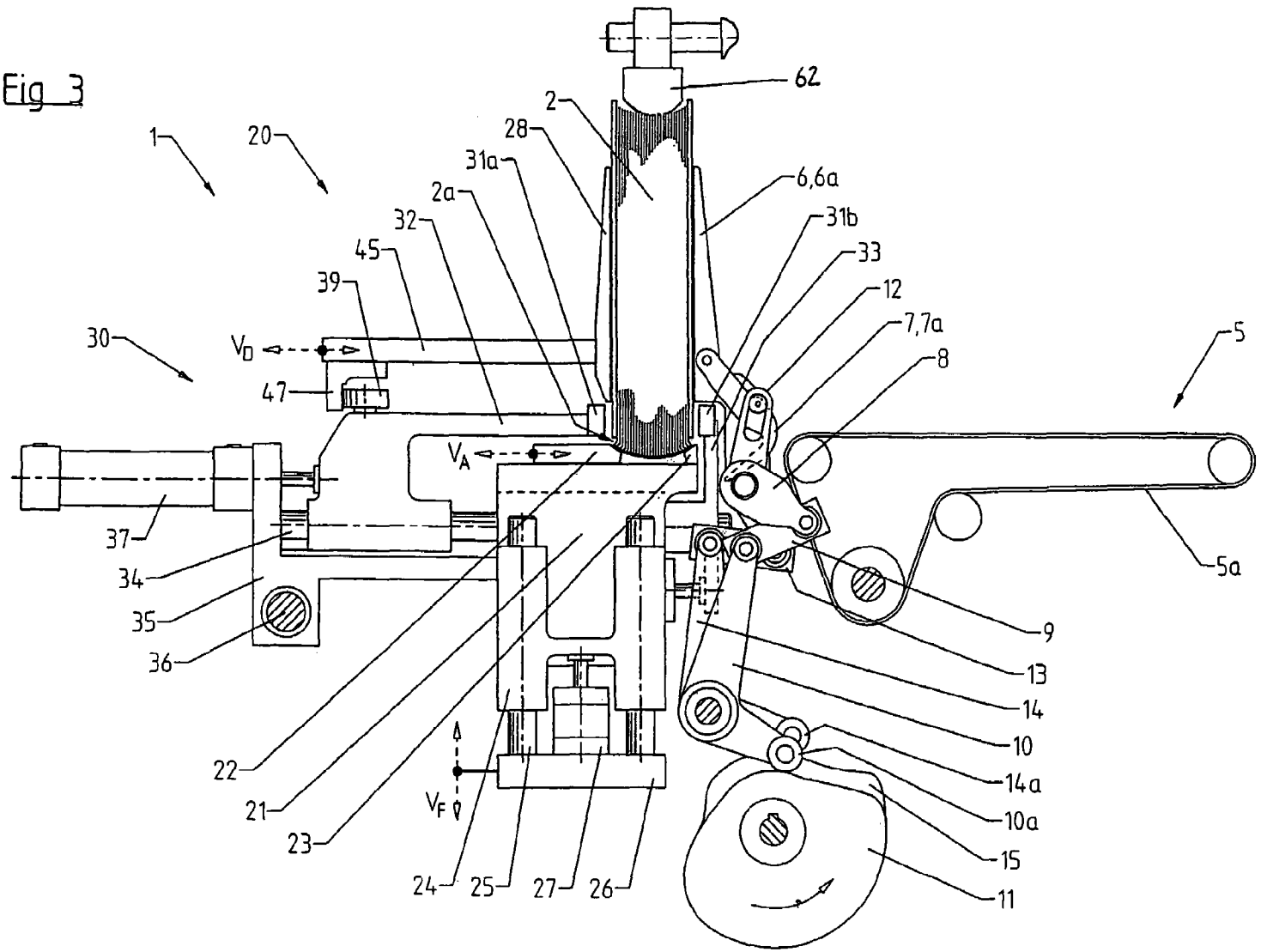
FIG. 3, is the same sectioned side view, however, with the feeding gate in the vertical position.
Figure 4:
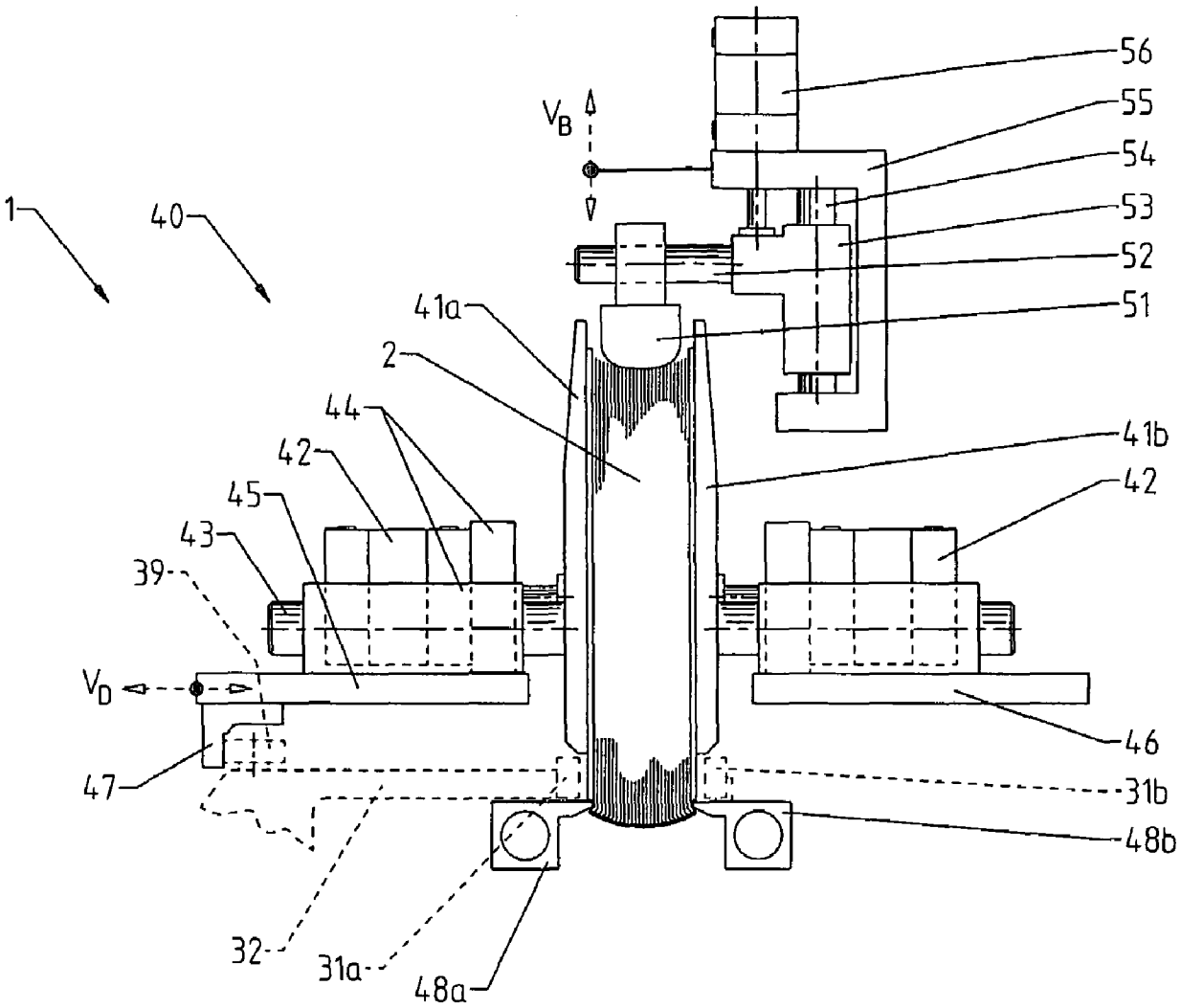
FIG. 4, is a sectioned side view of the pre-forming station of the machine, wherein this figure is sectioned along the line IV-IV in FIG. 1.

The feeding gate 6 is illustrated in its vertical position in FIG. 3. The book 2 stands on the alignment table 21 and is vertically guided by the supporting tines 7*a* on one side and a guide plate 28 on the other side. The contact tines 7*a* are pivoted into their retracted position by lever links 12. Their movements are controlled by a coupler 13 with the aid of a cam lever 14, the cam roller 14*a* of which is controlled by a cam plate 15 in such a way that the contact tines 7*a* are oriented perpendicular to the supporting tines 6*a* during the vertical positioning movement and the contact tines continue their pivoting movement into the retracted position through recesses in the alignment table 21 when the book is vertical positioned thereon. As the feeding gate 6 is pivoted back, the contact tines 7*a* initially remain in the retracted position and are subsequently returned into the position in which they are oriented perpendicular to the supporting tines 6*a* during the course of the pivoting movement.

The vertically positioned book 2 on the alignment table 21 is now aligned such that its book case joints 2*a* are arranged at the desired height. The outer edges of the book spine are supported by prismatic rails 22, 23 of the alignment table 21 that respectively contain an inwardly sloped, plane supporting surface, wherein the weight of the book 2 acts upon these prismatic rails. In order to increase the aligning forces in the alignment station 20, holding-down means 62 may optionally act upon the front edges of the book cases and/or upon the front edge cut of the book block. The left rail 22 is realized adjustably in order to take into account different book thicknesses. This is symbolized in FIGS. 2 and 3 by the double arrow VA drawn with broken lines. The alignment table 21 itself is guided on guide shafts 25 by a guide block 24 and can be adjusted between a raised position in which it aligns the books 2 and a lowered position in which it releases the book spine, by a pneumatic cylinder 27 mounted on a plate 26. The height of the plate 26 can be adjusted as symbolized by $V_F$ in order to adjust the alignment table 21 to a certain height for the alignment process.

The aligned book 2 is laterally clamped in lateral regions near the joints by the clamping jaws 31*a, b* of a clamping conveyor 30 and transferred from the alignment station 20 into the pre-forming station 40 with a transport stroke $H_K$. During this process, the lateral regions of the book case near the joints are firmly glued to the end sheets to such a degree that the formation of creases is prevented when the book is subsequently pressed into the book case joints for the first time. The alignment table 21 is situated in a lowered position during this process, and the feeding gate 6 is pivoted back into the horizontal position in order to receive an ensuing book 2. In its vertical position, the feeding gate 6 with the retracted contact tines 7 has such a geometry that a free space for the right clamping jaw 31*b* is created.

The clamping conveyor 30 with its clamping jaws 31*a, b* is situated on a carriage 35 that is linearly guided on guide shafts 36 such that it can be displaced between the alignment station 20 and the pre-forming station 40 with the aid of not-shown driving means. In this case, the transport stroke $H_K$ is variable in accordance with the format to be processed, i.e., the book 2 that is fed to the alignment station 20 with a constant lateral edge always reaches the center of the pre-forming station 40.

Guide shafts 34 are arranged on the carriage 35 transverse to the transport direction. Holders 32, 33 are guided on the guide shafts, and the clamping jaws 31*a* and 31*b* are mounted on the respective ends of the holders and can be adjusted into a clamping position for receiving the books 2 from the alignment station 20 with the aid of pneumatic cylinders 37, 38. The left pneumatic cylinder 37 has a stroke that not only takes into account the required clamping stroke of the clamping jaw 31*a*, but also changes in the thickness of the books 2. In order to limit the operational stroke to the value required for the clamping process, a cam roller 39 is provided on the holder 32 and supported on the guide rail 47 that is adjustable with respect to the thickness of the book when the clamping jaw 31 opens.

The pre-forming station 40 is essentially composed of a forming rail 51 that acts upon the front edge cut of the book block, clamping plates 41*a, b* that laterally limit the book case and the joint rails 48*a, b* that engage into the book case joints 2*a*. When the aligned book 2 is transferred into the pre-forming station 40, the clamping plates 41*a, b* and the forming rail 51 are respectively situated in the retracted position as indicated with broken lines in FIG. 2. After the transfer, the book 2 initially is laterally clamped in position by the clamping plates 41*a, b*. The clamping jaws 31*a, b* are then opened and the clamping conveyor 30 returns into the alignment station 20 in order to receive another aligned book 2.

Immediately after the book 2 is clamped in position in the pre-forming station 40, the forming rail 51 is softly lowered onto the front edge cut of the book block. As soon as the joint rails 48*a, b* are adjusted into the book case joints 2*a* such that they exert a slight pressure, the pressure of the forming rail 51 is increased and the clamping force of the clamping plates 41*a, b* is diminished immediately thereafter. The book block is now pressed into the book case spine that is supported on the clamped book case joints 2*a* via the center strip and the end sheet. Different joint shapes can be realized in this case depending on the position and the clamping force of the joint rails 48*a, b*. The clamping force of the clamping plates 41*a, b* is particularly important in this respect, because the clamping force can be diminished, according to a first operating mode, to such a degree that the book 2 to be post-formed is merely guided in a loose fashion between the clamping plates 41*a, b*. During the post-forming, the book 2 is displaced downward until the edges of the book case come in contact with the joint rails 48*a, b*. During this process, the cloth is pressed against the case edges in order to produce a sharp book case joint.

In another operating mode, the clamping plates 41*a, b* act upon the book case with a high clamping force during the pre-forming. The joint rails 48*a, b* are simultaneously pressed against the book case joints with a high clamping force such that the book case cannot move downward when the forming rail 51 acts thereupon. This makes it possible to maintain a predetermined position of the respective joint rails 48*a, b* in the book case joint. A direct contact between the book cases and the joint rails 48*a, b* is prevented such that a book case joint of reduced sharpness is produced. The described second operating mode can also be used for books with thin book cases, for example, flexible book cases that are so thin that they do not provide a sufficient support edge for being placed on the joint rails 48*a, b* analogous to the first operating mode.

The joint rails 48*a, b* are situated on the carriage 50 for the joint forming rails 49*a, b* and moved into the pre-forming station 40 during the return stroke of the carriage. After the pre-forming process is completed, the clamping force of the joint rails 48*a, b* is increased while the forming rail 51 and the clamping plates 41*a, b* are adjusted into their retracted position. The book 2 is now transferred into the first of the ensuing pressing stations 60 by means of the joint rails 48*a, b* that solidly engage into the book case joints 2*a*. The book is received in this first pressing station while being positively clamped in position with the aid of press plates 61*a, b* and then transported from pressing station to pressing station in a cyclic fashion by the heated joint forming rails 49*a, b*. The joint rails 48*a, b* are also heatable such that the plastic deformation of the book case joints 2*a* can already begin in the pre-forming station 40 when certain cloth materials are used.

The forming rail 51 is realized in the form of an interchangeable part and held on a bolt 52 received in a block 53 that is guided on guide shafts 54. The guide shafts 53 are mounted on a holder 55 of adjustable height. A pneumatic cylinder 56 for realizing the lifting movement of the forming rail 51 is also mounted on this height-adjustable holder.

The clamping plates 41*a, b* are controlled by pneumatic cylinders 42, and guide shafts 43 mounted on the clamping plates 41*a, b* are linearly guided in bearing blocks 44. On the right side, the bearing block 44 is mounted on a plate 46 that is rigidly connected to the machine frame while the bearing block 44 on the left side is mounted on a plate 45 that can be adjusted with respect to the book thickness and on which the aforementioned guide rail 47 is also arranged. The adjusting device is not illustrated in detail but rather symbolized by a double arrow $V_D$ drawn with broken lines.

The invention claimed is:

1. A binding-in and pressing machine for the pressing-in and joint forming of books in which a book case having cover boards and a spine surrounds a book block, comprising:

a plurality of pressing stations that are arranged in a straight row and equidistantly spaced apart from one another, wherein said pressing stations respectively comprise a pair of press plates for exerting pressure upon the sides of the book and are adjustable with respect to their mutual distance;

heated joint forming rails associated with the pressing stations and respectively arranged opposite one another pair-by-pair, for forming book case joints of the book, wherein the joint forming rails are situated on a reciprocating carriage for advancing the books from pressing station to pressing station in a cyclic fashion;

a pre-forming station upstream of the pressing stations for post-forming rounded book blocks, including a forming rail that acts downwardly upon the upward facing front edge cut of the book block, clamping plates that laterally limit the book case cover boards, and joint rails that engage into the book case joints and counteract a downward movement of at least the book case joints while the book block is pressed into the book case spine by the forming rail;

a book alignment station upstream of the pre-forming station for aligning the book case joints at the height of the joint forming rails including a height-adjustable alignment table with spaced apart rails for forming and supporting the book from below on the outer edges of its spine and guide elements acting on the book case cover boards for centering the book on the alignment table; and a clamping conveyor with clamping jaws that clamp the books in position on the alignment station in lateral regions near the joints along the entire length of the book after the book case joints have been aligned at the height of the joint forming rails, wherein only said clamping conveyor provides the transport and joint alignment of the books from the alignment station into the pre-forming station.

2. The binding-in and pressing machine according to claim 1, wherein the alignment station includes a reciprocating feeding gate that vertically positions the books arriving in an essentially flat position and places the books on the alignment table, and supporting tines of the feeding gate move in recesses of the alignment table.

3. The binding-in and pressing machine according to claim 2, wherein the alignment station includes a contact gate that can be pivoted relative to the feeding gate, and said contact gate supports the book spine while the book is positioned vertically and adjusted into a retracted position when the feeding gate is pivoted back.

4. The binding-in and pressing machine according to claim 2, wherein the feeding gate serves as a guide element in its vertical position and centers the book on the alignment table together with a guide plate.

5. The binding-in and pressing machine according to claim 3, wherein the contact gate is adjusted into the retracted position when the feeding gate is in its vertical position, whereby a free space for the respective clamping jaw of the clamping conveyor is created in the lateral region of the book near the joint.

6. The binding-in and pressing machine according to claim 1, wherein the rails of the alignment table are prism rails with sloped, planar support surfaces for the outer edges of the book spines, and the distance between the rails is adjustable with respect to the book thickness.

7. The binding-in and pressing machine according to claim 1, wherein the alignment table can be lowered into a position in which it is spaced apart from the book spine during the transport of the book into the pre-forming station.

8. The binding-in and pressing machine according to claim 1, including holding-down means in the alignment station that act upon at least one of the front edges of the book case and the front edge cut of the book block.

9. The binding-in and pressing machine according to claim 1, wherein the joint rails are arranged on the carriage for transferring the aligned and pre-formed books into the first pressing station.

10. The binding-in and pressing machine according to claim 9, wherein the joint rails press into the book case joints and maintain a low clamping force during the pre-forming and maintain a high clamping force during transport of the book to the pressing station.

11. The binding-in and pressing machine according to claim 1, wherein the forming rail is initially placed and held onto the front edge cut with a low pressing force and subsequently presses and post-forms the book block against the book case spine after the book case joints are taken hold of by the joint rails.

12. The binding-in and pressing machine according to claim 1, wherein the clamping plates of the pre-forming station can be adjusted into a clamping position in which they exert a high clamping force in order to receive the aligned books from the clamping conveyor.

13. The binding-in and pressing machine according to claim 12, wherein the clamping plates adjoin the book and maintain a low clamping force during the pre-forming or provide a defined guide channel in which the book is tightly guided, such that both book cases are pulled against the joint rails via the center strip and the end sheet when the book block is pressed down.

14. The binding-in and pressing machine according to claim 12, wherein the clamping plates and the joint rails respectively press against the book cases and into the book case joints with a high clamping force during the pre-forming.

15. The binding-in and pressing machine according to claim 3, wherein the feeding gate serves as a guide element in its vertical position and centers the book on the alignment table together with a guide plate.

16. The binding-in and pressing machine according to claim 4, wherein the contact gate is adjusted into the retracted position when the feeding gate is in its vertical position, whereby a free space for the respective clamping jaw of the clamping conveyor is created in the lateral region of the book near the joint.

17. The binding-in and pressing machine according to claim 10, wherein the forming rail is initially placed and held onto the front edge cut with a low pressing force and subsequently presses and post-forms the book block against the book case spine after the book case joints are taken hold of by the joint rails.

18. The binding-in and pressing machine according to claim 11, wherein the clamping plates of the pre-forming station can be adjusted into a clamping position in which they exert a high clamping force in order to receive the aligned books from the clamping conveyor.

19. The binding-in and pressing machine according to claim 18, wherein the clamping plates adjoin the book and maintain a low clamping force during the pre-forming or provide a defined guide channel in which the book is tightly guided, such that both book cases are pulled against the joint rails via the center strip and the end sheet when the book block is pressed down.

* * * * *